United States Patent [19]

Mosterd

[11] 4,045,073

[45] Aug. 30, 1977

[54] DEVICE FOR DISPLACING AN EGG-TRAY

[75] Inventor: Jacob Hendrik Mosterd, Barneveld, Netherlands

[73] Assignee: Moba Holding Barneveld B.V., Barneveld, Netherlands

[21] Appl. No.: 673,141

[22] Filed: Apr. 2, 1976

[30] Foreign Application Priority Data

Apr. 11, 1975 Netherlands ..... 7504326

[51] Int. Cl.[2] ..... B66C 1/02; B66C 1/46

[52] U.S. Cl. ..... 294/87 A; 294/63 A; 294/65

[58] Field of Search ..... 294/1 R, 2, 63 A, 64 R, 294/65, 86 R, 87 R, 87 A, 87.22, 87.24, 113; 214/1 BS, 1 BT, 1 BH, 1 BV, 114, 650 SG, 651

[56] References Cited

U.S. PATENT DOCUMENTS

| | | | |
|---|---|---|---|
| 978,049 | 12/1910 | Morris | 294/87 A |
| 2,698,097 | 12/1954 | Magnani | 214/1 BT |
| 2,803,485 | 8/1957 | Page et al. | 294/65 |
| 3,061,352 | 10/1962 | Hirt | 294/65 |
| 3,306,646 | 2/1967 | Flora | 294/2 |
| 3,387,718 | 6/1968 | Roth et al. | 294/64 R X |
| 3,559,371 | 2/1971 | Borrowman | 294/86 R X |

FOREIGN PATENT DOCUMENTS

| | | | |
|---|---|---|---|
| 2,263,477 | 7/1973 | Germany | 294/64 R |

*Primary Examiner*—Johnny D. Cherry

*Attorney, Agent, or Firm*—Larson, Taylor and Hinds

[57] ABSTRACT

The invention shows a device for displacing an egg-tray filled with eggs, provided with supporting members bearing the weight of the tray and a suction device sucking the eggs and bearing their weight during the displacement of the egg-tray.

8 Claims, 9 Drawing Figures

DEVICE FOR DISPLACING AN EGG-TRAY

The invention relates to a device for displacing an egg-tray, said device being provided with a movable gripper having supporting members, which are adapted to engage and support an egg-tray.

Such devices are known, e.g., from Dutch Pat. No. 142,916.

In practice it has appeared that the known devices work satisfactorily, provided the egg-trays come up to certain requirements, in particular with respect to dimensional constancy and strength. It occurs, however, that the trays are damaged locally or have been used some times already and hence are weak, so that it can happen, that a tray on which eggs are present, bends under the weight of the eggs, slips out of the supporting members and falls with the eggs and everything. In particular when automatically handling the eggs, this can lead to considerable periods of stand-still.

Furthermore the lack of form constancy, e.g., when the edge of the tray is damaged, forms a serious problem when supporting the tray. When e.g., the supporting members work at a permanent height and the tray is damaged, the possibility exists that the supporting members will engage the tray at an incorrect location and will further damage the tray or will not support the tray in the right way. This can happen, in particular, when the tray is under the weightload of eggs, and this can again lead to falling down of the tray.

The invention provides a solution of the above-mentioned problems. Accordingly, the invention provides that the gripper is provided with a suction device, which is adapted to suck itself on the eggs which are present on the tray and to bear the weight of the eggs when the tray is supported by the gripper.

Devices for supporting eggs by suction for removing them from or depositing them on an egg-tray are known, see e.g., Dutch Pat. No. 97,371.

Because, when applying the invention, the trays need only be supported by a force which is sufficient to bear the weight of the tray only, a much smaller force exerted by the supporting members on the trays will suffice than with known constructions.

Accordingly, it is possible according to the invention to provide that the supporting members are adapted to be moved toward the edge of a tray along a height which is large in comparison with the thickness of the edge of the tray. Because only the weight of the tray need to be borne by the supporting member, said way of supporting can successfully be applied, without it being necessary to exert forces on the edge of the tray which would damage said edge.

An advantageous embodiment of the above-mentioned idea consists in that the supporting members comprising inflatable members, which are adapted to be inengagement with the edge of the tray when they are inflated.

According to a further embodiment of the invention, the supporting members comprise fingers, which are adapted to move toward the edge of a tray to be supported by the gripper, said fingers being almost vertical in the position in which they have been moved toward the tray.

Such fingers can, if desired, be provided with knurls.

With the embodiment of the invention, in which fingers are used, it can be provided that the fingers are resilient, so that the force which a finger can exert upon the edge of an egg-tray, is limited, and it is still possible to assure a good support of the tray, also when the location of the edge of the tray deviates a little bit, e.g., because the tray is damaged locally.

A simple further elaboration of the invention is obtained by providing that the supporting members are coupled with a pneumatic motor engine, which is connected to the suction device. With this embodiment the suction device obtains the double task of sucking and weight of the eggs and operating the supporting members.

The invention will be elucidated below with reference to the accompanying drawing, in which.

Figure 1:
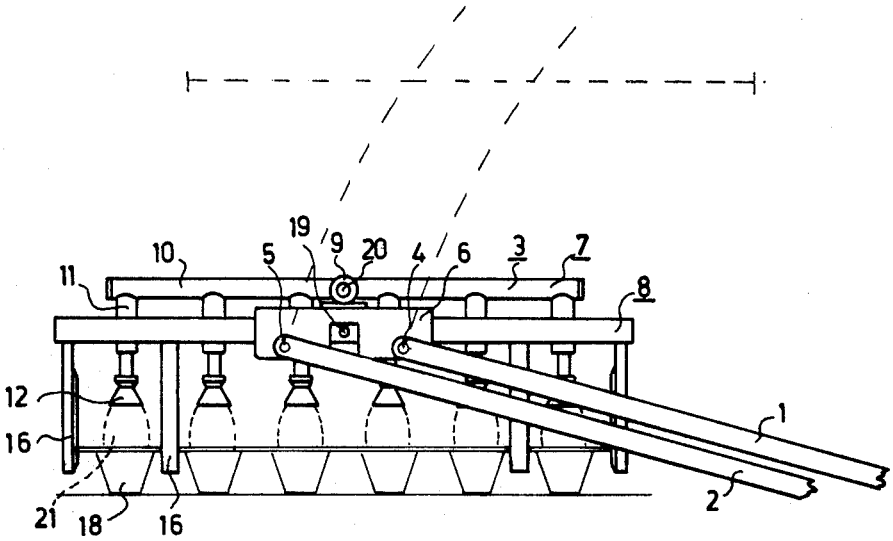
FIG. 1 show schematically a side-elevation of a device according to the invention.

In FIG. 1 a pair of pivotable arms are indicated by 1 and 2, which serve for displacing the gripper according to the invention, which in general is indicated by 3. The mechanism for driving the pivot movement of the arms 1 and 2 does not form part of the invention and any mechanism which causes them to pivot mutually parallel, can be used. Arms 1 and 2 are by means of pivot connections 4 and 5 mounted with an angle iron 6, which on the one hand mounts a first pipe frame 7 and on the other hand mounts a second pipe frame 8. As appears more in particularly in FIG. 3, pipe frame 7 consists of a central pipe 9 with transverse tubes 10, to which downwardly directed pipes 11 are connected, which at their lower end (see again in FIGS. 2 and 3) bear sucking cups 12. This construction is known in itself.

Furthermore, the angle iron 6, as stated already, supports frame 8. This consists of a hollow edge profile 13 with downwardly directed connection nipples 14, to which inflatable members 15 are connected. Said inflatable members 15 are at their outer sides supported by partial sleeves 16 (see FIGS. 4 and 5).

Figure 4:
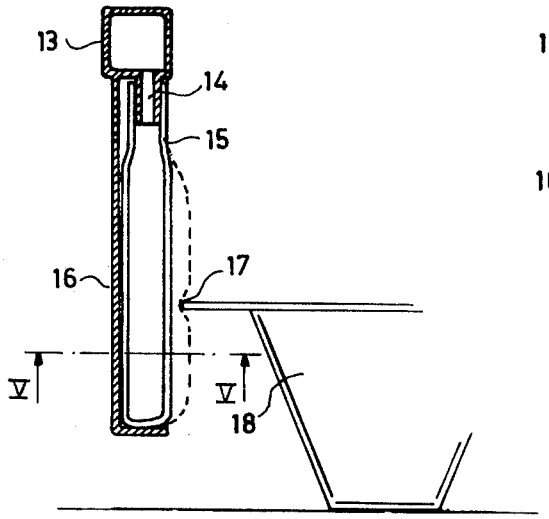
FIG. 4 shows a detail on a larger scale.
Figure 5:
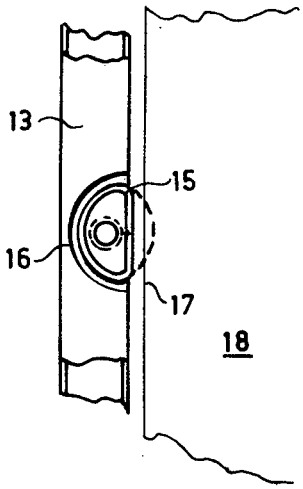
FIG. 5 shows a top view of the detail of FIG. 4.

In FIG. 4 by dotted lines the position is indicated, in which the member 15 is in its inflated position in which it contacts edge 17 of an egg-tray 18.

Frame 8 is via a connection 19 connected with a source of compressed air (not shown) via control members (not shown) such as cocks. Frame 7 is via the connection 20 connected with a device for generating sub-pressure, also via control members (not shown). In this connection it is pointed out, that controlling such members with compressed air or suction air is known in itself and that when applying the invention any known system can be used for this purpose.

The working of the described device is as follows. First gripper 3 is brought into the position shown in FIG. 1 relative to the tray 18 filled with eggs 21. Therewith the sucking cups 12 contact the eggs. Thereupon sub-pressure is brought into the frame 7 by means of the connection 20, so that the eggs are fixedly sucked by the sucking cups 12. Furthermore compressed air is supplied, preferably at the same time, to the connection 19, by which the inflatable member 15 take the position indicated in dotted lines in figures 4 and 5 and engage edge 17 of tray 18. Thereupon the arms 1 and 2 are swung, by which the sucking cups bear the weight of the eggs and the inflatable members 15 bear the weight of the tray. Because the tray itself has a small weight it is possible to limit the force which is exerted by the inflatable members 15 upon the edge 17 to eliminate the chances of damaging the tray. Moreover, sucking cups 12 have a height which can easily can be selected sufficiently large to compensate all variations in the height position of the egg-tray. In this connection it is pointed out, that with many known constructions the egg-trays are stacked upon each other, with eggs, by which the height position of the uppermost tray is not exactly determined. When applying the invention it is now very easily posible to give members 15 a sufficient vertical length to comply with all possible variations in the height position of the tray.

Of course it will be clear that, when applying the main idea of the invention, only small forces have to be exerted upon edge 17 of tray 18, so that also other means that the inflatable members can be used to support the edge of the tray, e.g. vertical strips which move with a small force toward the edge of the tray.

Figure 2:
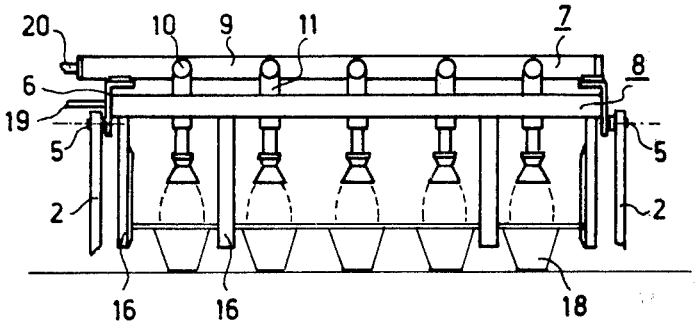
FIG. 2 is a side-elevation of the device according to FIG. 1.
Figure 3:
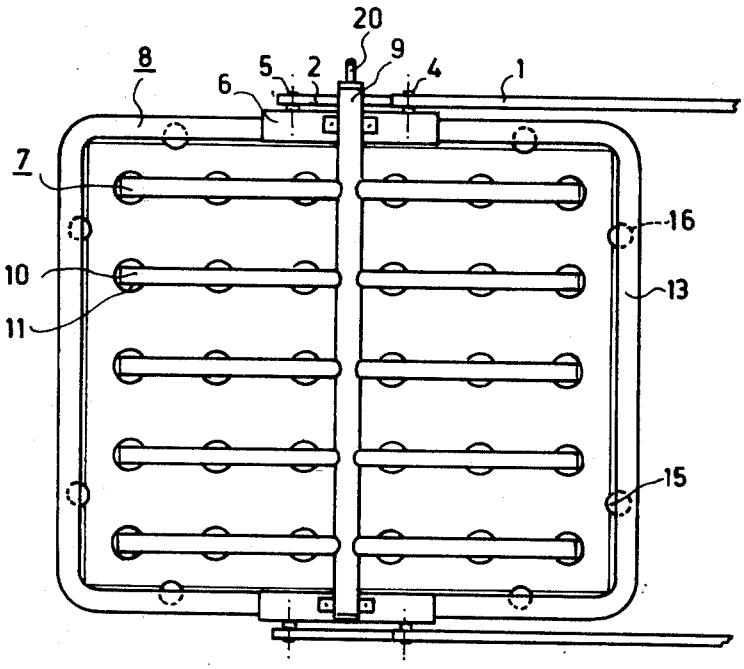
FIG. 3 shows a top view of the same device.
Figure 6:
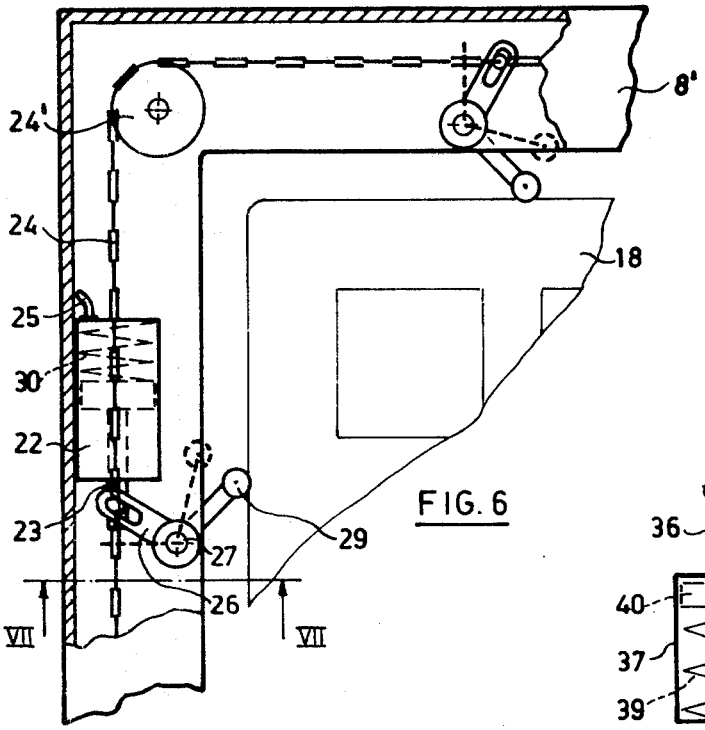
FIG. 6 shows a partial top view of a further embodiment of the invention; taken along the line VI—VI of FIG. 7.

In FIG. 6 an edge frame is indicated by 8', which corresponds with 8 in the embodiment of FIGS. 1 and 2. Said frame viewed in cross-section as in FIG. 9 has a U-shaped profile and a pneumatic motor engine 22 is provided inside the profile. The member 23 of motor engine 22 can be moved by means of suction air and is connected with a cord or chain 24. The cord or chain 24 is fed over guide rolls 24'. When a sub-pressure is applied to the connection 25, member 23 in FIG. 6 moves in a direction which is upwardly as viewed in FIG. 6. Swinging arms 26 are connected with the member 23, said arms being rotatably mounted on a pivot shaft 27, which is carried in the upper and lower wall portions of the U-shaped profile. At its lower side shaft 27 carries an arm 28, to which a knurled finger 29 is mounted.

When no suction is applied to the connection 25, member 23 will take the position schematically shown in dotted lines in FIG. 6, e.g., under the influence of a spring 30. If, however, suction is applied, the member 23 moves such, that the arms 28 are pivoted clockwise and will swing toward the tray 18 as indicated in FIG. 6.

The length of the fingers 29 must be such that even with an improbable height position of an egg-tray the latter is supported by the fingers. If desired, the fingers themselves or the arms to which they are mounted can be somewhat resilient to enable a gentle engagement with an egg-tray.

Figure 8:
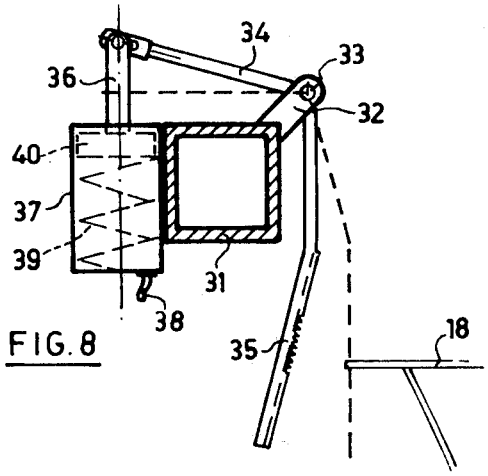
FIG. 8 shows a detail of still a further embodiment of the invention.
Figure 9:
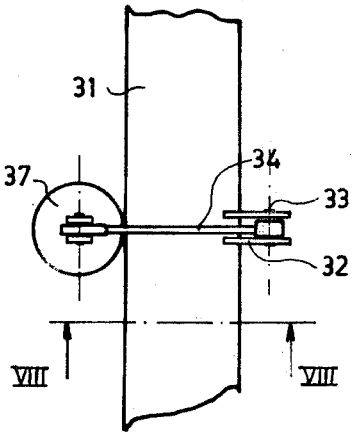
FIG. 9 shows a top view of the detail according to FIG. 8.

In FIGS. 8 and 9 a further embodiment of the invention is shown. Beam 31 corresponds again with the member 8 of FIGS. 1 and 2. On this beam a double strut 32 is provided, in which a shaft 33 is mounted, bearing a member 34. This member consists of an angle lever with an obtuse angle in one of the legs, said leg beyond the angle being provided with a knurl 35. The other leg of the member 34 is connected with a piston rod 36, forming part of a pneumatic motor engine 37 with a control connection 38. By means of a spring 39 the member 34 is kept in the position shown. If now a sub-pressure is applied via the connection 38, the piston 40 which is connected with the piston rod 36 moves downwardly, by which the member 34 rotates counter-clockwise and the knurled edge 35 in FIG. 8 swings to the right and can engage the edge of a schematically shown tray 18. It will be clear that when using a pneumatic motor engine it is desired to select for this an engine which is capable of working with sub-pressure, because operating the fingers must always take place at the same time as sucking of the eggs. Hence one single sub-pressure source is sufficient for the entire device. By this means the device becomes simple and reliable to a high degree. On the other hand it is of course possible to use other means for controlling the fingers. e.g., electromagnetic or mechanical drive means.

Figure 7:
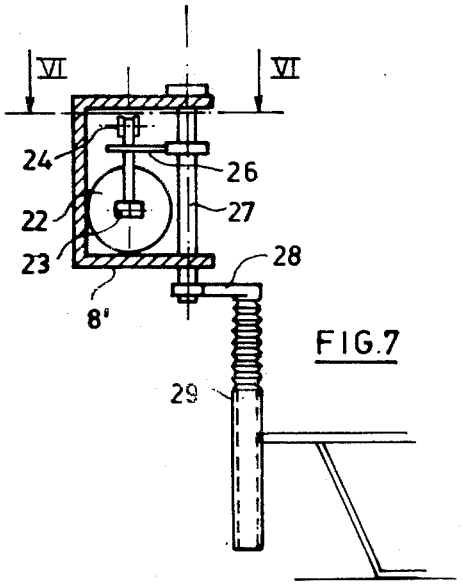
FIG. 7 shows a section on an enlarged scale, taken along the line VII—VII of FIG. 6.

Of course it is also possible to couple a number of fingers with each other or with other drive means than the pneumatic means in the manner elucidated for a pneumatic drive with reference to FIGS. 6 and 7.

Each of the embodiments has such supporting members, that in case of an improbable height position of the egg-trays, in which the supporting members also contact the second tray positioned underneath it, said second tray, also because it has to bear the full weight of the eggs resting upon it, is not taken along.

What is claimed is:

1. A gripper device for displacing an egg-tray filled with eggs comprising:

supporting members movable in a generally horizontal direction into engagement with a rim of an egg-tray, said supporting members having an edge gripping portion of a height greater than the thickness of the rim of the tray, said thickness being taken in a vertical direction, such that the vertical position of the rim can be varied over a given range, relative to the said edge gripping portion, and still be positioned to be gripped by the edge gripping portion and hence carried by the supporting members, a suction device comprising means for engaging the eggs in the tray by suction to support the weight of the eggs therein, and means for fixing the height of the supporting members relative to the suction device and moving them together to thereby carry away the egg-tray filled with eggs with the suction device bearing the weight of the eggs and supporting members bearing the weight of the tray.

2. A device according to claim 1, characterized in that the supporting members comprise inflatable members, which are positioned to contact the edge of the tray when they are inflated.

3. A device according to claim 1, characterized in that the supporting members comprising fingers, which are mounted to move toward the edge of a tray to be supported by the gripper device, said fingers, in the position moved toward the tray, being almost vertical.

4. A device according to claim 3, characterized in that the fingers at the side facing the tray are provided with a knurl.

5. A device according to claim 3, characterized in that the fingers are resilient.

6. A device according to claim 1, characterized in that the supporting members are coupled with a pneumatic motor engine, which is connected to the suction device.

7. A device according to claim 1, characterized in that at least a number of the supporting members are mechanically coupled together.

8. A device according to claim 1, said supporting members and said suction device both being mounted on a common frame with respect to which the supporting members move generally horizontally to grip the rim of the tray and with respect to which suction cups of the suction device move downwardly to engage the eggs in the tray.

* * * * *